United States Patent [19]

Dyett et al.

[11] 4,305,409

[45] Dec. 15, 1981

[54] CIGARETTE MAKING MACHINES

[75] Inventors: Derek H. Dyett; Kenneth B. Matthews; Jan A. Rakowicz, all of London, England

[73] Assignee: Molins Limited, London, England

[21] Appl. No.: 60,478

[22] Filed: Jul. 25, 1979

[30] Foreign Application Priority Data

Jul. 29, 1978 [GB] United Kingdom ..... 31629/78

[51] Int. Cl.[3] ..... A24C 5/18

[52] U.S. Cl. ..... 131/84 B

[58] Field of Search ..... 131/84, 110, 77

[56] References Cited

U.S. PATENT DOCUMENTS 3,173,424 3/1965 Gamberini ..... 131/110

FOREIGN PATENT DOCUMENTS 930053 7/1963 United Kingdom ..... 131/84 B 1322733 7/1973 United Kingdom ..... 131/84 C

*Primary Examiner*—Robert W. Michell

*Assistant Examiner*—Thomas Wallen

*Attorney, Agent, or Firm*—Craig and Antonelli

[57] ABSTRACT

A cigarette making machine includes at least one transfer wheel for transferring the filler stream onto the wrapper web, and air guide vanes extending in approximately tangential directions towards the transfer wheel. As a result, the vanes arrest any particles of tobacco which fly off the wheel, and air streams induced by the suction in the wheel tend to return the particles to the wheel with a forward component of motion.

15 Claims, 4 Drawing Figures

CIGARETTE MAKING MACHINES

This invention is concerned with cigarette making machines, especially machines of the type in which a cigarette filler stream is conveyed by an air-pervious conveyor with the aid of suction. Examples of such machines are the Molins Mark 8 and Mark 9 cigarette making machines.

This invention is more particularly concerned with machines in which a cigarette filler stream is transferred onto a wrapper web from a conveyor band by one or more suction wheels. Examples of such machines are described in British Patent Specifications Nos. 1,322,732, 1,386,778 and 1,456,975, all of which are referred to in their entirety.

According to the present invention, in a cigarette making machine which includes at least one suction wheel for carrying the cigarette filler stream towards the wrapper web, there are air guide vanes extending in approximately tangential directions towards the transfer wheel so that air streams passing along the vanes arrive at the wheel with directions of motion approximately the same as those of adjacent parts of the filler stream carried by the wheel. Accordingly, any particles of tobacco which fly off the wheel under centrifugal force tend to be carried back onto the wheel and to be propelled by the air in the direction of motion of the tobacco on the wheel. Furthermore, the return of the tobacco particles to the wheel is assisted by the fact that the particles tend, on flying off the wheel, to strike the vanes, after which they tend to be carried back onto the wheel in the appropriate direction of the air flowing along the vanes.

This invention is particularly applicable to a machine in which the transfer wheel concerned is of relatively small diameter so that centrifugal force on the tobacco is a significant factor.

Other aspects of this invention will be described with reference to the accompanying drawings, which show one example of a machine according to this invention. In the drawings.

Figure 1:
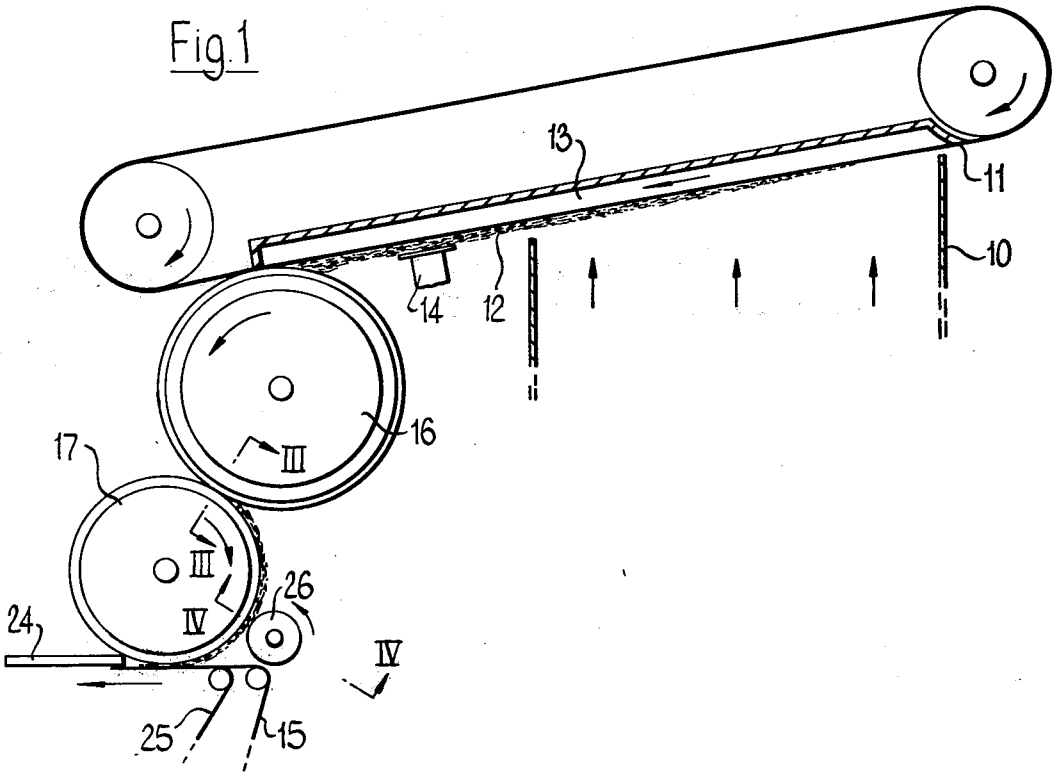
FIG. 1 is a diagrammatic front view showing the general arrangement of a machine having two transfer wheels.

FIG. 1 shows a machine which is basically in accordance with the invention described in British Patent Specification No. 1,456,975. Tobacco is showered upwards through a chimney 10 by means of an upward-flowing air stream, and builds up on the underneath surface of an air-pervious band 11 to form a cigarette filler stream 12. Suction in a suction chamber 13 holds the filler stream on the band. A trimmer 14 removes part of the filler stream and the remainder is transferred to a wrapper web 15 by two transfer wheels 16 and 17. The directions of motion of the band 11 and of the wheels 16 and 17 are as shown by arrows.

Figure 2:
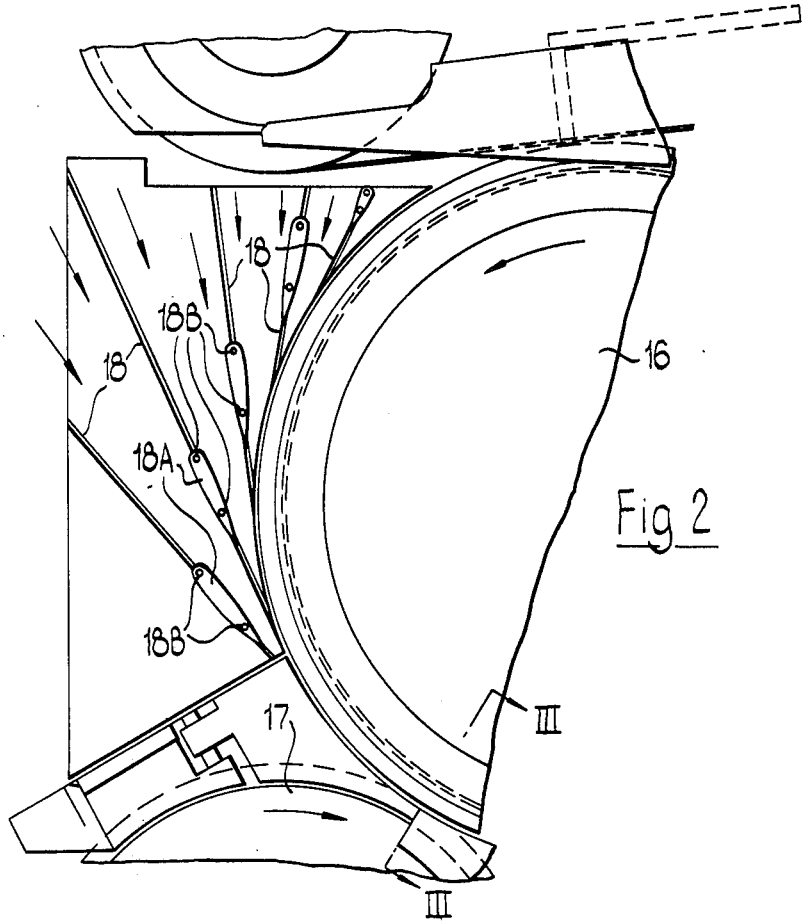
FIG. 2 is an enlarged view of part of FIG. 1, showing guide vanes adjacent to the first of the transfer wheels.

FIG. 2 shows part of the transfer wheel 16 in the region where the wheel 16 carries the cigarette filler stream. At regularly spaced intervals around the wheel there are fixed vanes 18 which lie substantially tangential to the wheel; as a result, air flowing towards the wheel (i.e. drawn into the wheel by suction within the wheel) reaches the wheel with a direction of movement approximately the same as that of the tobacco on the wheel.

Each vane 18 includes an enlarged portion 18A of aerofoil cross-section. Fixing screws 18B engage in the portions 18A to secure the vanes between parallel fixed side walls (not shown) which are normal to the axis of rotation of the wheel 16. The portions 18A may also tend to accelerate the air streams as they approach the wheel; in fact, the whole of each vane, or a substantial part of it, may be shaped with an aerofoil cross-section for that purpose.

Figure 3:
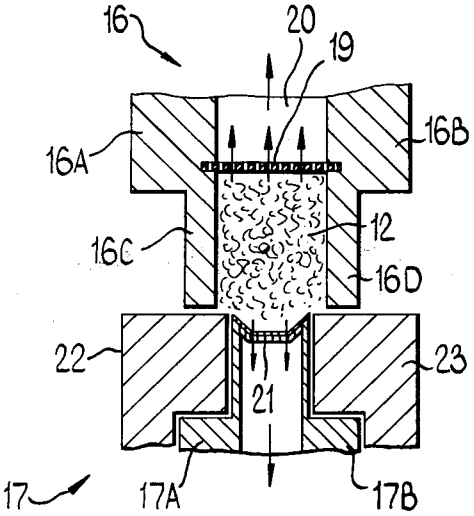
FIG. 3 is a section on the line III—III in FIGS. 1 and 2.

The construction of the wheel 16 is shown more clearly in FIG. 3. The wheel comprises spaced disc portions 16A and 16B with flanges 16C and 16D which define a peripheral groove containing the cigarette filler stream 12. The bottom of the groove is defined by an air-pervious annular rim 19. It will be understood that the space 20 between the disc portions 16A and 16B communicates with a source of suction so that air is drawn inwards through the rim 19 to hold the filler stream 12 in the groove.

The wheel 17 similarly is formed by spaced disc portions 17A and 17B. However, apart from the fact that the air-pervious rim 21 is slightly concave in section (in an angular fashion), there is no distinct groove in the wheel 17. Instead, the sides of the filler stream, while being carried by the wheel 17 are confined mainly by fixed side walls 22 and 23 (see particularly FIG. 4), these side walls being cut away in the region of the wheel 16 as shown in FIG. 3.

As an alternative, the wheel 16 may also have associated fixed side walls for confining at least outer parts of the sides of the filler stream. For example, the flanges 16C and 16D may be reduced in diameter, and the outer portion of the filler stream 12 may be confined between fixed side walls.

Instead of the inner faces of the flanges 16C and 16D being parallel, as shown in FIG. 3, they may diverge in an outward direction to allow easier removal of the filler stream from the wheel 16.

The suction wheel 17 may also have associated vanes, like those mounted adjacent to the wheel 16, in the region of the periphery of the wheel 17 along which the filler stream is carried.

Figure 4:
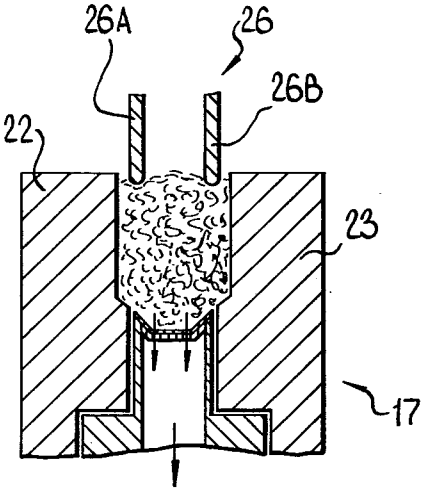
FIG. 4 is a section on the line IV—IV in FIG. 1.

As shown in FIG. 1, the filler stream is deposited on the wrapper web 15, which is itself carried through a rod-forming device 24 by a garniture tape 25 in a well-known manner. Immediately before being deposited on the web 15, the filler stream may be compressed by means of a compressor wheel 26 rotating with a peripheral speed substantially equal to that of the filler stream. As shown in FIG. 4, the compressor wheel may comprise two axially spaced disc portions 26A and 26B allowing air to flow between them towards the filler stream. Alternatively, a single-disc wheel may be used and may be arranged to press centrally on the filler stream. If the trimming device 14 is arranged to leave additional quantities of tobacco at regular intervals to form dense end portions, the compressor wheel 26 may have an irregular periphery so as to engage and compress only those portions of the filler stream, or may have recesses to accommodate the dense end portions.

The compressor wheel has other applications; in particular, it is not necessarily associated with a machine having the air-guide vanes. In general, its preferred use is in connection with a machine having a transfer wheel for carrying the filler stream onto the wrapper web; the compressor wheel compresses the filler stream mechanically immediately before the stream is deposited on the wrapper web. The compressor wheel may be shaped so as to impart a slightly convex cross-section to the outer surface of the filler stream; the use of spaced disc-like portions (as shown in FIG. 4) tends to have that effect. This is desirable because the wrapper web 15 is normally in a curved state (in cross-section) by the time the filler stream is deposited on it.

To assist in shaping the filler stream, the rim 19 in the wheel 16 may be concave in cross-section.

I claim:

1. A cigarette making machine including at least one suction transfer wheel for carrying the cigarette fillter stream towards a wrapper web, and a plurality of air guide vanes extending in approximately tangential directions towards the transfer wheel and being sufficiently closely spaced to define at least one air channel through which air streams pass along the vanes so as to arrive at the wheel with directions of motion approximately the same as those of adjacent parts of the filler stream carried by the wheel, the ends of the vanes adjacent to the transfer wheel being spaced from the outer surface of the filler stream on the transfer wheel so as to be out of physical contact therewith.

2. A cigarette making machine according to claim 1 in which the cigarette filler stream is formed on an air-pervious band, is carried by the band with the aid of motion, is trimmed while on the band and is then received by the transfer wheel, which carries the filler stream towards the wrapper web.

3. A cigarette making machine according to claim 1 or claim 2 in which one or more of the vanes includes or comprise an aerofoil portion.

4. A cigarette making machine according to claim 1 in which the vanes are secured between parallel fixed side walls.

5. A cigarette making machine according to claim 4 in which the side walls confine at least part of the sides of the filler stream while it is being carried by the transfer wheel.

6. A cigarette making machine according to claim 1 including a second transfer wheel which receives the filler stream from the first-mentioned transfer wheel and then deposits it on the wrapper web.

7. A cigarette making machine according to claim 6 in which the periphery of the second transfer wheel is concave in cross-section.

8. A cigarette making machine according to claim 6 or claim 7 including fixed side walls which confine at least part of the sides of the filler stream while it is being carried by the second transfer wheel.

9. A cigarette making machine according to claim 1 including a compressor wheel arranged to compress the filler stream immediately before the filler stream arrives on the wrapper web.

10. A cigarette making machine according to claim 9 in which the compressor wheel comprises axially spaced disc portions allowing air to flow between them and towards the filler stream.

11. A cigarette making machine including at least one suction wheel for carrying the cigarette filler stream towards a wrapper web, and a plurality of air guide vanes extending in approximately tangential directions towards the suction wheel and being spaced to define at least one air channel through which air streams pass along the vanes so as to arrive at the wheel with directions of motion approximately the same as those of adjacent parts of the filler stream carried by the wheel, at least one of said vanes including an aerofoil portion to increase the velocity of the air in said channel, the ends of the vanes adjacent to the suction wheel being spaced from the outer surface of the filler stream on the suction wheel so as to be out of physical contact therewith.

12. A cigarette making machine according to claim 11 in which the vanes are secured between parallel fixed side walls.

13. A cigarette making machine according to claim 12 in which the side walls confine at least part of the sides of the filler stream while it is being carried by the transfer wheel.

14. A cigarette making machine according to claim 11 including a compressor wheel arranged to compress the filler stream immediately before the filler stream arrives on the wrapper web, said compressor wheel comprising axially spaced disc portions allowing air to flow between them and towards the filler stream.

15. A cigarette making machine according to claim 11 wherein all of said plurality of air guide vanes include an aerofoil portion.

* * * * *